US011779170B2

(12) United States Patent
Wallberg et al.

(10) Patent No.: US 11,779,170 B2
(45) **Date of Patent: *Oct. 10, 2023**

(54) ADJUSTABLE TOILET SEAT ADAPTER

(71) Applicant: The Happy Penguin, LLC, New York, NY (US)

(72) Inventors: Ruth Wallberg, New York, NY (US); LaVonne Strand, Folcroft, PA (US)

(73) Assignee: The Happy Penguin, LLC, New York, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/572,429

(22) Filed: Jan. 10, 2022

(65) Prior Publication Data

US 2022/0125251 A1 Apr. 28, 2022

Related U.S. Application Data

(63) Continuation-in-part of application No. 16/918,987, filed on Jul. 1, 2020, now Pat. No. 11,219,342.

(60) Provisional application No. 62/869,200, filed on Jul. 1, 2019.

(51) Int. Cl.

| | |
|---|---|
| ***A47K 13/28*** | (2006.01) |
| ***A47K 17/02*** | (2006.01) |
| ***A47K 13/26*** | (2006.01) |
| ***A47K 13/06*** | (2006.01) |

(52) U.S. Cl.

CPC ..... *A47K 13/28* (2013.01); *A47K 13/06* (2013.01); *A47K 13/26* (2013.01); *A47K 17/02* (2013.01)

(58) Field of Classification Search

CPC ..... A47K 13/28; A47K 13/06; A47K 13/26; A47K 17/02

USPC ..... 4/237, 239, 235, 245.1–246.1; 297/188.09

See application file for complete search history.

(56) References Cited

U.S. PATENT DOCUMENTS

| | | | | |
|---|---|---|---|---|
| 3,341,867 A * | 9/1967 | Keen | A47K 13/28 D23/311 |
| 5,524,295 A * | 6/1996 | Ford | A47K 13/06 4/239 |
| 8,893,316 B1 * | 11/2014 | Smith | A47K 13/005 4/667 |
| 11,219,342 B2 * | 1/2022 | Wallberg | A47K 13/26 |

(Continued)

FOREIGN PATENT DOCUMENTS

WO WO-2022200618 A1 * 9/2022

*Primary Examiner* — Lori L Baker

(74) *Attorney, Agent, or Firm* — Tarter Krinsky & Drogin LLP

(57) ABSTRACT

A toilet seat adapter device that is configured to be positioned on a rear section of a standard toilet seat in order to reduce the size of the seat opening. The adapter has a main body that is configured to be seated within the toilet seat opening. A first pair of movable arms extend form the right side of the main body and a second pair of movable arms extend form the left side of the main body. Each pair of movable arms terminate in clamp or similar gripping interface to capture a toilet seat and maintain the main body securely positioned on the toilet. The pairs of movable arms may be secured at any of various points to allow a user to apply the adapter to any of various sized toilet seats. One more LEDs may be encapsulated in or embedded on the toilet seat adapter.

6 Claims, 15 Drawing Sheets

(56) References Cited

U.S. PATENT DOCUMENTS

| | | | | |
|---|---|---|---|---|
| 2005/0257314 | A1* | 11/2005 | Bernsley | A47K 13/06 4/239 |
| 2014/0101832 | A1* | 4/2014 | Wagner | A47K 13/005 4/239 |
| 2015/0366417 | A1* | 12/2015 | Grant | A47K 13/06 4/239 |

* cited by examiner

ADJUSTABLE TOILET SEAT ADAPTER

RELATED APPLICATIONS

This application is a continuation in part of pending U.S. application Ser. No. 16/918,987 filed Jul. 1, 2020 and which is to issue as U.S. Pat. No. 11,219,342 on Jan. 11, 2022, which itself claims the benefit of U.S. Provisional Patent Application Ser. No. 62/869,200 filed Jul. 1, 2019, the contents of which are fully incorporated by reference herein.

FIELD OF THE INVENTION

The invention relates to the field of toilet seats, more specifically to an apparatus for modifying and adapting standard-size toilet seats for use by small children.

BACKGROUND OF THE INVENTION

A standard toilet typically has an oval shaped toilet seat, shaped and sized for use by an adult. Because of the large size of a conventional toilet seat, small children cannot comfortably use such toilets without extra support by, for example, propping themselves up with their arms and hands.

Conventional toilet seat adapters for children are typically shaped like a standard toilet seat, but are sized to provide a narrowed opening over the toilet to form a seat sized for a child. Generally, such child seats are configured to be positioned on top of, or over, the existing standard toilet seat. However, such convention seat adapters are bulky and are unable to be easily transported due to their size and inability to be collapsed and/or retracted.

There exists a need for a lightweight, portable apparatus that can be placed on a standard toilet seat that allows a child to use a standard size toilet without the risk of falling in, and without having to make contact with the toilet bowl. The accessory, once installed allows a toddler or child to remain on the toilet with stability and security.

SUMMARY OF THE INVENTION

Embodiments of the invention are directed to a child toilet seat adapter that extends across a standard toilet seat, thereby narrowing the opening of the seat to accommodate a small child.

In embodiments of the invention, the device is formed of a main body shaped to fit within the rear opening of a standard toilet seat. The main body is configured to provide back support to the child and comprises arms that are configured to extend from the body to the outer rim of the existing toilet seat. The arms are then positioned and adjusted to the size of the toilet seat, and kept in place on the seat through the use of detents. At the end of use, the arms may then be retracted into the body.

In alternative embodiments of the invention, a device is formed of two vertical posts with a clamping mechanism at the bottom end of each post. The ends of flexible material such as a band is configured to be placed over the vertical posts and extend between the posts and maintained taut to provide back support. The posts may be positioned on a standard toilet seat at a depth to lessen the opening of the seat to accommodate a child. The clamping mechanism is extended from the inner circumference of the rim of the seat to the outer circumference, and locked into position. At the end of use, the clamping mechanisms are released and the posts are free.

Other principal features and advantages of the invention will become apparent to those skilled in the art upon review of the following drawings, the detailed description, and the appended claims.

BRIEF DESCRIPTION OF THE DRAWINGS

Illustrative embodiments of the invention will hereafter be described with reference to the accompanying drawings, wherein like numerals denote like elements.

DETAILED DESCRIPTION OF THE INVENTION

Embodiments of the present invention will now be described with reference to the above-identified Drawings. However, the Drawings and the description herein are not intended to limit the scope of the claims. It will be understood that various modifications of the present description are possible without departing from the spirit of the invention. Also, features described herein may be omitted, additional features may be included, and/or features described herein may be combined in a manner different from the specific combinations recited herein, all without departing from the spirit of the invention.

Figure 1B:
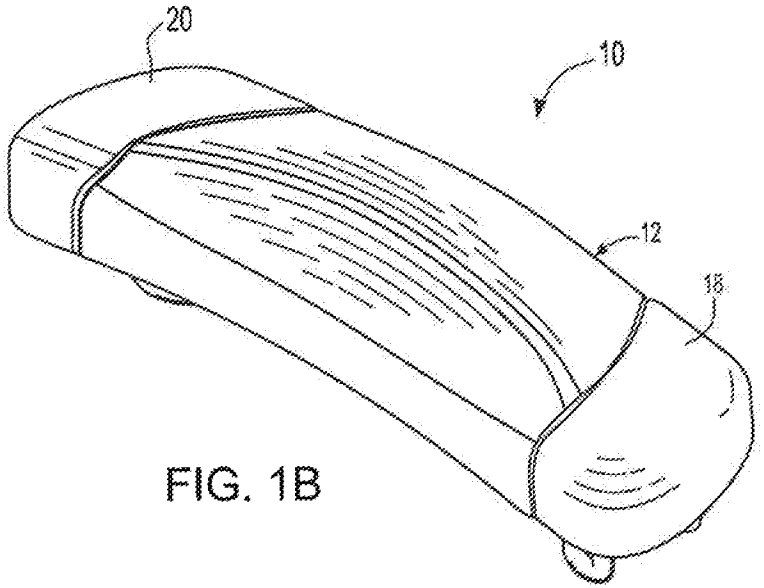
FIG. 1B is a top perspective view of a toilet seat adapter, in a closed position, according to an exemplary embodiment of the invention.
Figure 1A:
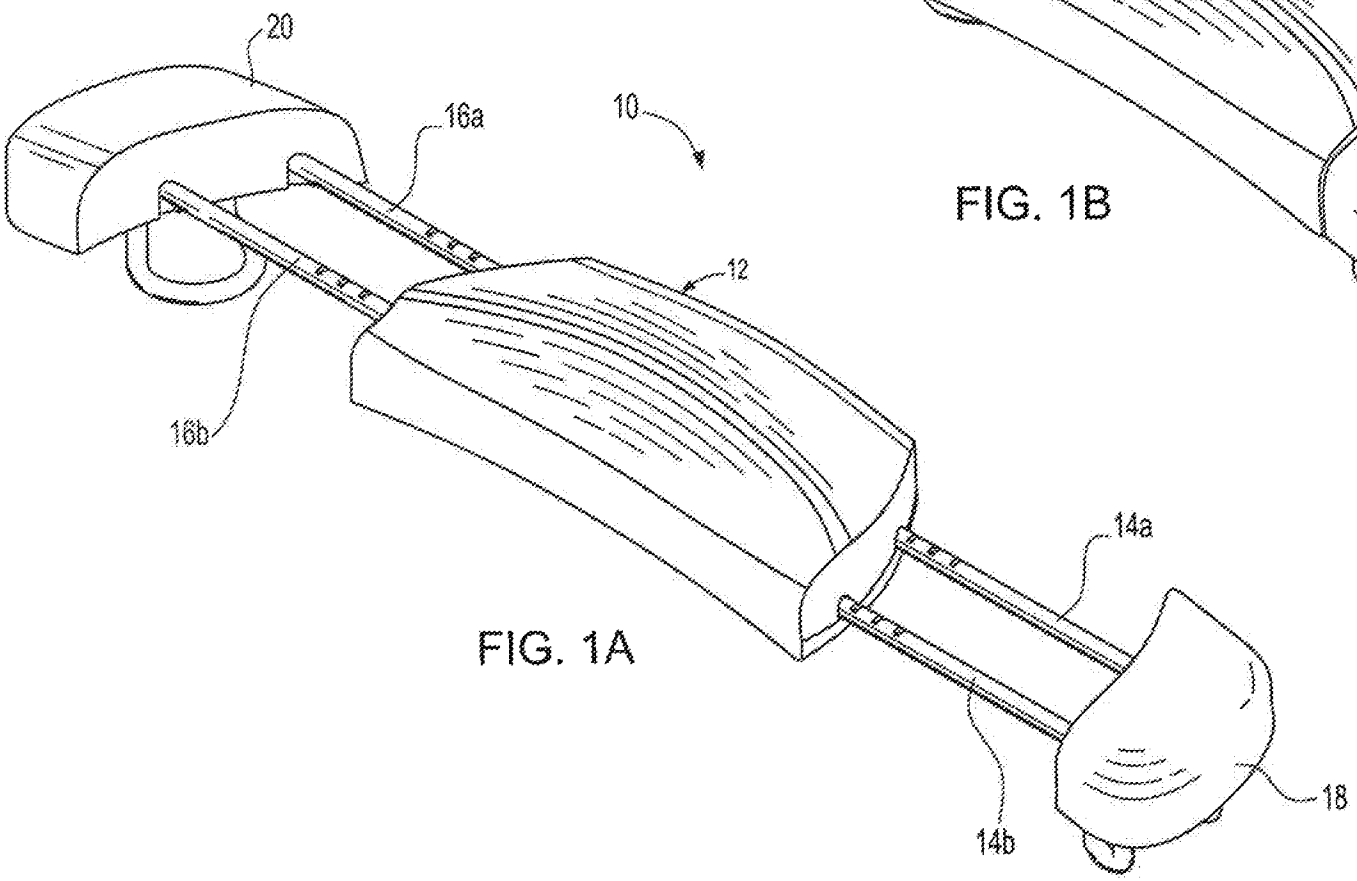
FIG. 1A is a top perspective view of a toilet seat adapter, in an expanded position, according to an exemplary embodiment of the invention.

FIG. 1A-B shows a perspective view of a toilet-seat adapter 10 that is configured to be positioned on top of an existing standard toilet seat to create a smaller opening to accommodate a child. FIG. 1A shows adapter 10 in its extended position, when in use; FIG. 1B shows adapter 10 in its closed position, when not in use. Adapter 10 may be attached and secured to any standard toilet seat, and detached and collapsed to allow for easy transport. In embodiments of the invention, adapter 10 is comprised of a main body 12, and two pairs of moveable arms 14 and 16 that extend from each side of the main body. For example, a first pair of arms 14, comprising first arm 14*a* and second arm 14*b*, extend from a right side of main body 12. A second pair of arms 16, comprising first arm 16*a* and second arm 16*b*, extend from a left side of the main body 12. In embodiments of the invention, moveable arms (e.g. 14*a*, 14*b* and 16*a*, 16*b*) terminate in handles that are configured for easy gripping and handling by a user. With reference to FIG. 1A, handle 18 is attached to arms 14*a* and 14*b*, and handle 20 is attached to arms 16*a* and 16*b*.

It will be understood that embodiments of the invention a singular right movable arm and a singular left movable arm may be provided rather than a pair of right and left movable arms. In other embodiments of the invention, only a single movable arm or pair of movable arms is provided extending from one side of the main body 12.

In embodiments of the invention, adapter 10 is generally shaped to fit within the back portion of the opening of a standard toilet seat. It will be understood that main body may be formed in any of various sizes and shapes and is configured to occupy or be supported above the back portion (e.g. the side closer to the toilet tank) of a toilet seat (for example, as shown in FIGS. 9-15). In embodiments of the invention, and as shown for example, in FIG. 9B, adapter 10 is shaped to be installed in a reversible manner. In this regard, and as shown, adapter 10 could be installed on the front half of a toilet seat (i.e. the half closer to the user when approaching the toilet head on) to create a smaller opening to accommodate a user.

Figure 16:
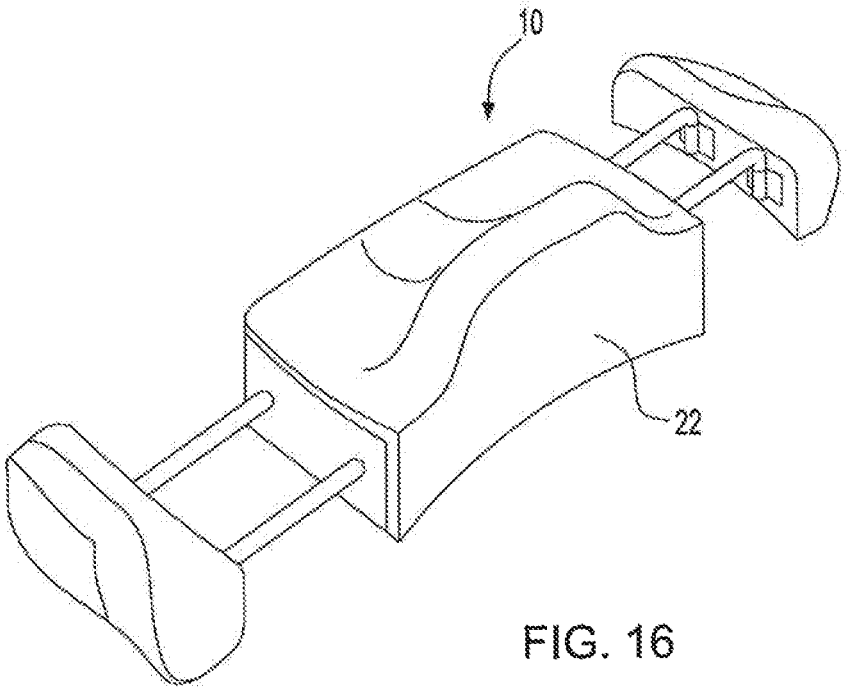
FIG. 16 is a side perspective view of a toilet seat adapter, in an expanded position, according to an exemplary embodiment of the invention.
Figure 17:
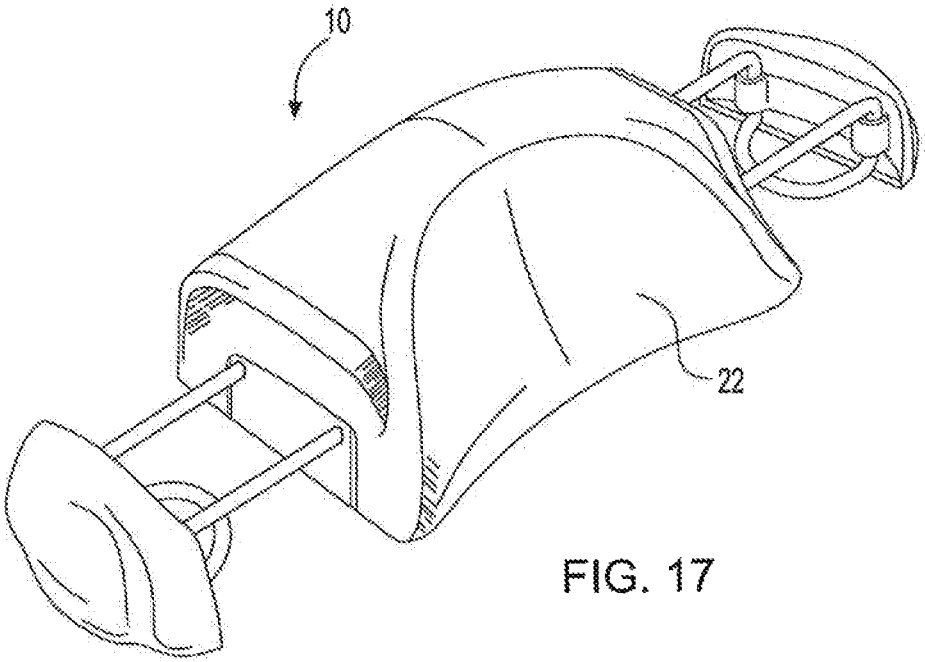
FIG. 17 is a side perspective view of a toilet seat adapter, in an expanded position, according to an exemplary embodiment of the invention.
Figure 18:
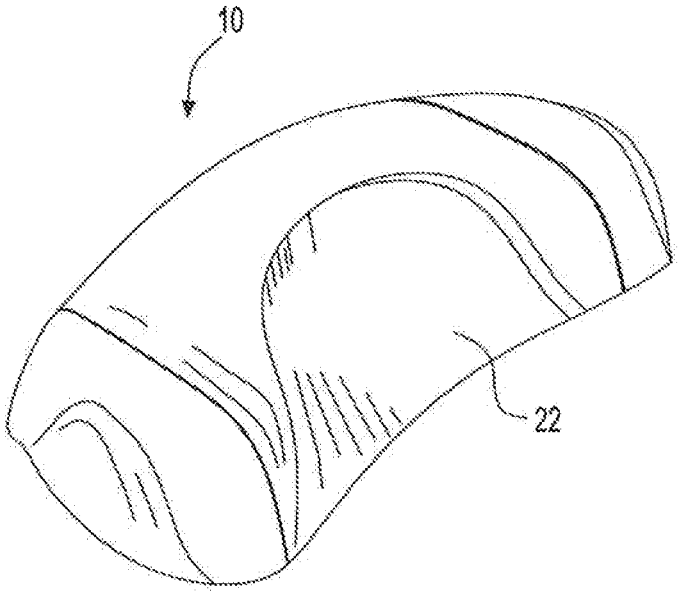
FIG. 18 is a side perspective view of a toilet seat adapter, in a closed position, according to an exemplary embodiment of the invention.
Figure 19:
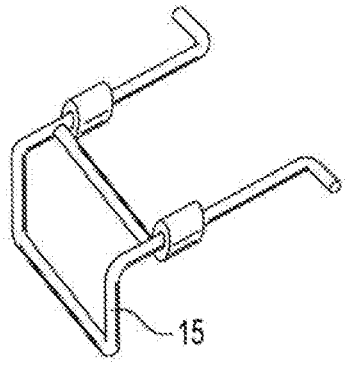
FIGS. 19-23 are side perspective view of different embodiments of the terminal ends of arms of a toilet seat adapter, according to exemplary embodiments of the invention.

FIGS. 16-18 show the various different shapes and sizes adapter 10 may take on. Adapter 10 may have a taller profile, for example, as shown in FIG. 17, in order to provide extra back support for the child. In embodiments of the invention, adapter 10 may have a shorter profile, for example, as shown in FIG. 18, providing a more compact configuration for easy portability. In embodiments of the invention, the main body 12 has a rounded profile that is configured to fit within either a rear or a front segment of a toilet seat.

In embodiments of the invention, front surface 22 of adapter 10 is configured to provide back support for the child. In embodiments of the invention, front surface 22 may have a concave aspect, as shown, for example, in FIGS. 17-18. In embodiments of the invention, front surface 22 may be straight or flat, as shown, for example, in FIG. 16.

Figure 2:
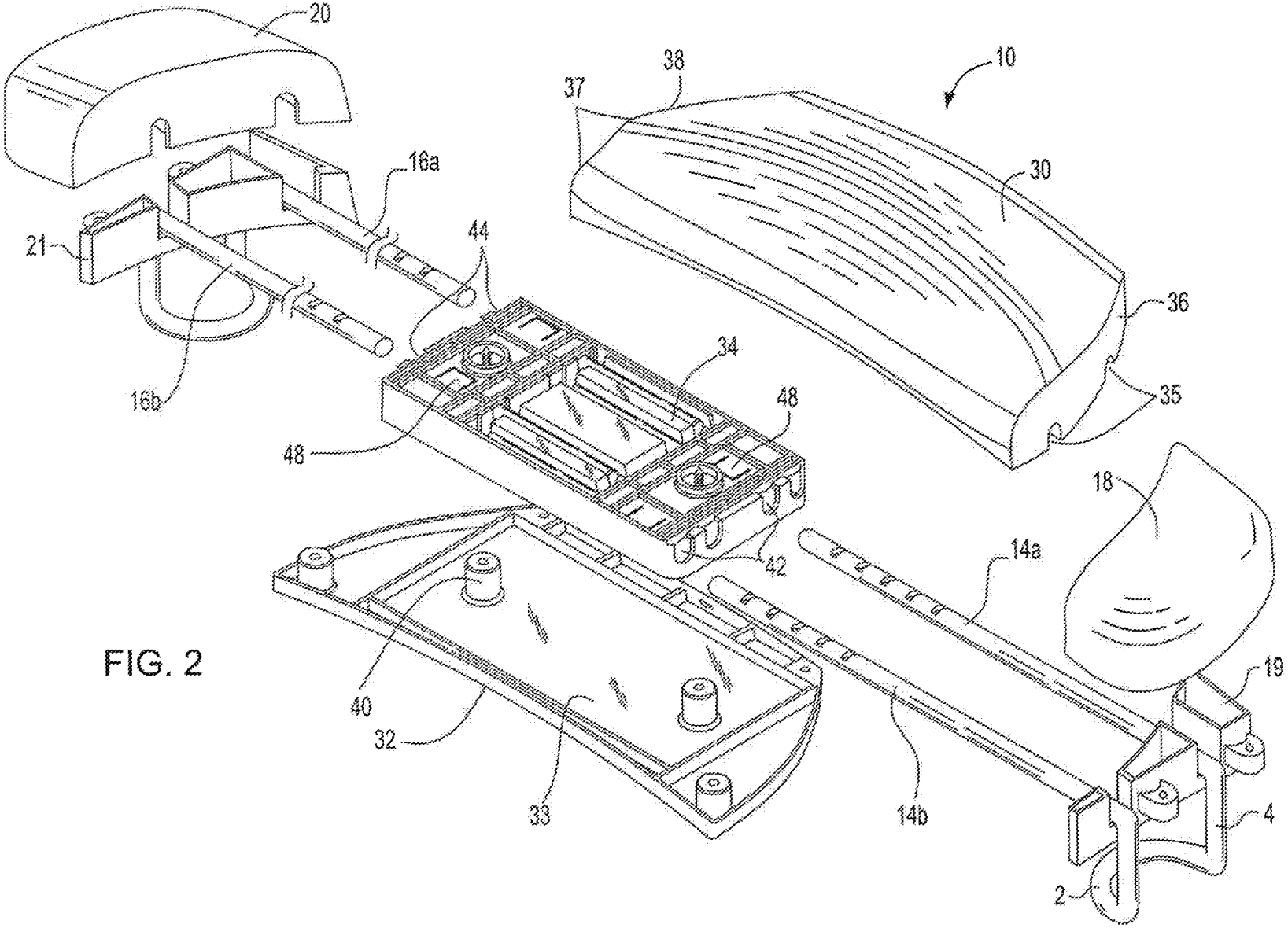
FIG. 2 is an exploded view of a toilet seat adapter according to an exemplary embodiment of the invention.

FIG. 2 shows an exploded view of adapter 10. In embodiments of the invention, main body 12 is comprised of a seat top 30 and seat base 32, which form a housing that encloses an arm sliding mechanism 34. Seat top 30 has an upper surface 31 that faces upward during use and an underside surface that contains fastening points for attaching seat base 32. Seat base 32 has an upper surface 33 and an underside surface that faces the toilet during use. Underside surface of seat top 30 is substantially parallel to upper surface 33 of seat base 32. When fastened to one another, seat top 30 and seat base 32 form a hollow cavity that encloses sliding mechanism 34 and the first ends of arms (e.g. 14*a*, 14*b*, and 16*a*, 16*b*). In embodiments of the invention, cooperating screw-retaining posts 40 are provided on upper surface 33 of seat base 32 and underside surface of seat top 30 to receive screws for connecting seat top 30 to seat base 32.

In embodiments of the invention, pairs of arms 14 and 16 extend from main body 12. In embodiments of the invention, arms 14*a* and 14*b* are separate independent arms. In other embodiments of the inventions, arms 14*a*, 14*b* and 16*a*, 16*b* are formed of a single rod having elongated segments that are formed into a terminal elongated u-shape. It will be understood that arms 14*a*, 14*b* and 16*a*, 16*b* may be made of a lightweight yet sturdy material, including, but not limited to, a metal (e.g., stainless steel) or plastic material, able to be formed into the intended shape.

Figure 20:
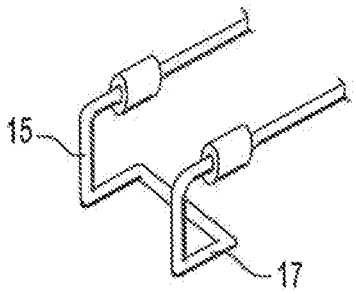
Figure 21:
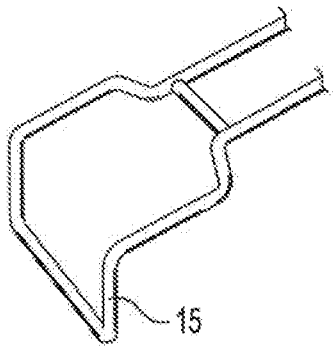
Figure 22:
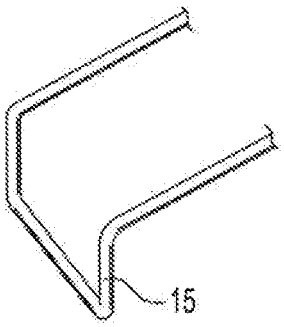
Figure 23:
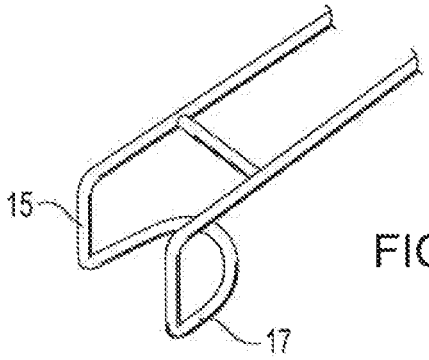

In embodiments of the invention, in formation of terminal ends, arms (e.g. 14*a*, 14*b*, and 16*a*, 16*b*) turn downward to form a bridging segment (e.g., bridging segment 15, as shown in FIGS. 19-23 or segment 4 of FIG. 2) that is substantially at a right angle with the elongated portion of arms (e.g., arms 14*a*, 14*b*, and 16*a*, 16*b*). Bridging segments (e.g. bridging segment 15) turn inward to form a u-shape (e.g., as shown by FIG. 23 or segment 2 of FIG. 2) or square shape (e.g., as shown by FIG. 20) or similar shape. Such u-shape or similar shape is configured to occupy a plane that is substantially parallel to, and below, the elongated segments of arms (e.g., arms 14*a*, 14*b*, and 16*a*, 16*b*) that extend from the main body 12. This allows the user to secure the adapter 10 under the rim of the toilet seat. In this regard, the u-shape creates a lower contacting surface (e.g., lower contacting surface 17, as shown in FIGS. 20 and 23) for contacting the underside surface of a toilet seat and to grasp the seat between the lower contacting surface and elongated segments of arms. In embodiments of the invention, rubber or similar friction-inducing materials are provided on clamping interfaces of embodiments of the invention.

In embodiments of the invention, as shown in FIG. 2, seat top 30 has a pair of openings 35 and 37 on side surfaces 36 and 38, respectively, distanced and sized to insert the first end of arms 14*a*, 14*b* and 16*a*, 16*b* into arm sliding mechanism 34, within main body 12.

In embodiments of the invention, handles 18 and 20 are placed on the terminal ends of pairs of arms 14 and 16, respectively. Handles 18 and 20 are attached to pairs of arms 14 and 16 using a bracket mechanism 19 and 21, respectively. In embodiments of the invention, handles 18 and 20 are shaped so that when the arms are pushed into main body 12, the surface of the handles in contact with the side surfaces 36 and 38 of seat top 30 of main body 12 are aligned and form a closed and cohesive shape.

Figure 3:
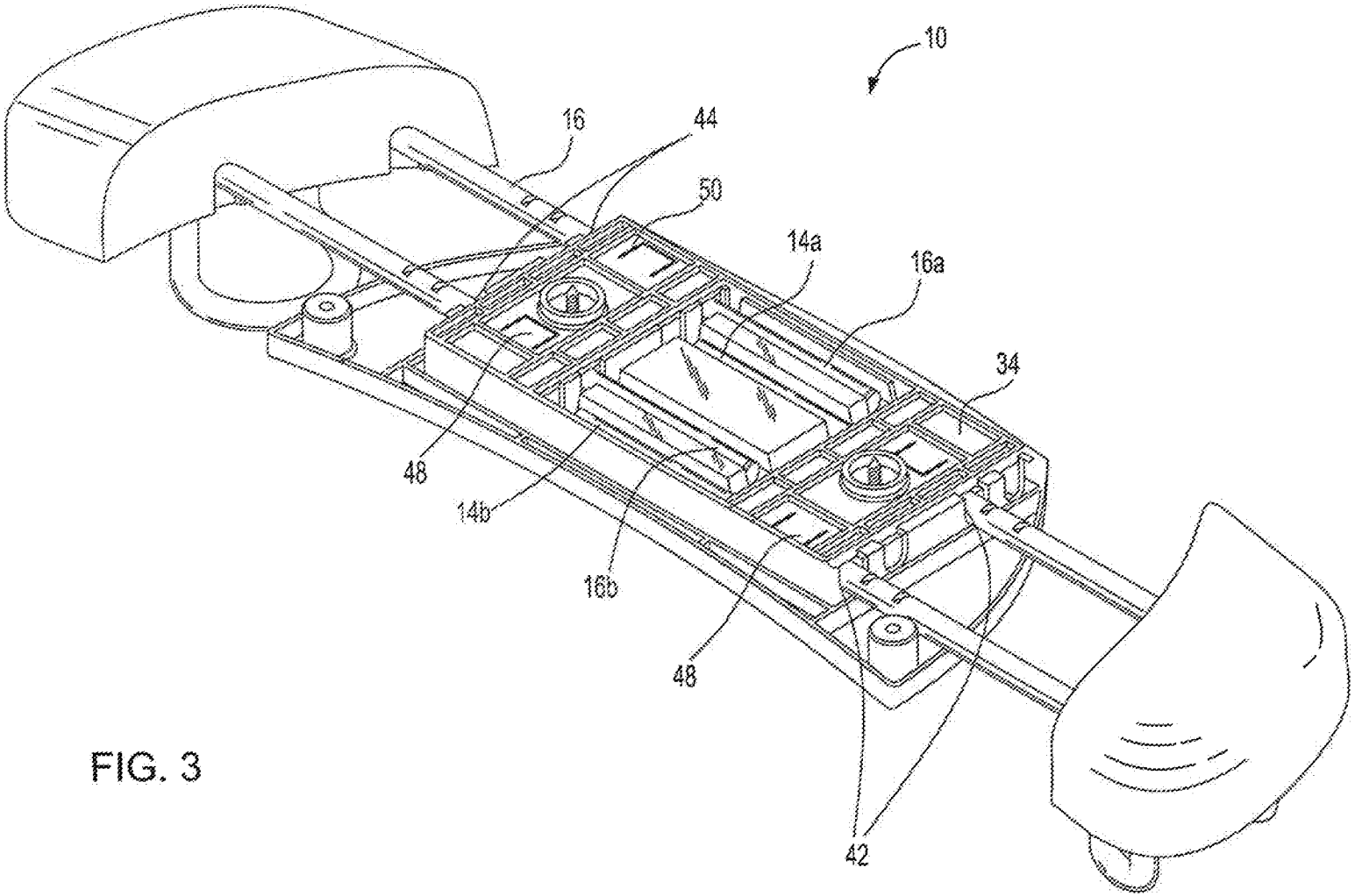
FIG. 3 is a top perspective view of a toilet seat adapter, with its cover removed, according to an exemplary embodiment of the invention.

FIG. 3 is a top perspective view of adapter 10, with seat top 30 removed, showing a closer view of arm sliding mechanism 34. In embodiments of the invention, arm sliding mechanism 32 comprises two pairs of channels 42 and 44, which hold pairs of arms 14 and 16, respectively, within main body 12. Channel pairs 42 and 44 are properly sized and distanced to accommodate the arms. Channel pairs 42 and 44 are offset from one another so that pairs of arms 14 and 16 do not run into each other. In this regard, arms 14*a*, 14*b* and 16*a*, 16*b* are configured in an intermeshed manner. For example, in the embodiment shown in FIG. 3, arm 14*a* is disposed in the space between arms 16*a* and 16*b* and arm 14*b* is disposed outside of the space between arms 16*a*, 16*b*. Such offsetting of moveable arms ensures that respective arms may travel past each other without contacting one another. For example, arms 14*a* and 14*b* travel in unison past arms 16*a*, 16*b* and vice versa.

In embodiments of the invention, respective channel pairs 42 and 44 are sized and shaped to be incrementally larger than an outer circumference of arms (e.g. 14*a*, 14*b*) such that they grip arms in a tight frictional engagement. In embodiments, arms (e.g. 14*a*, 14*b*) are securely held in place at any of various increments of extension.

In other embodiments of the invention an interlocking mechanism is utilized to secure arms at any of various positions along its elongated aspect. For example, in embodiments of the invention, arm sliding mechanism 34 includes a detent mechanism or similar projection mechanism to provide positioning at various extensions and allow adapter 10 to be held in a fixed position, but also allow for a quick and easy reposition (e.g., extension or closure). In embodiments of the invention, as shown in FIG. 2, notches 46 or similar depressions are formed on the top surface of arms 14*a*, 14*b*, and 16*a*, 16*b*, thereby providing detents. Notches 46 are arranged in increments to adjust adapter 10 to a multiple of various size toilet seats.

As shown in FIG. 3, in embodiments of the invention, a top wall 50 of arm sliding mechanism 34 is provided with fingers 48 that are formed integrally with top wall 50. In embodiments of the invention, fingers 48 are living hinges having a peg or prong on their underside surfaces that are sized and shaped to insert into any of the notches in arms 14*a*, 14*b* and/or 16*a*, 16*b*. In embodiments, fingers 48 are formed by cutting top wall 50 on three sides, leaving one side that is continuous with and connected to top wall 50.

Figure 4:
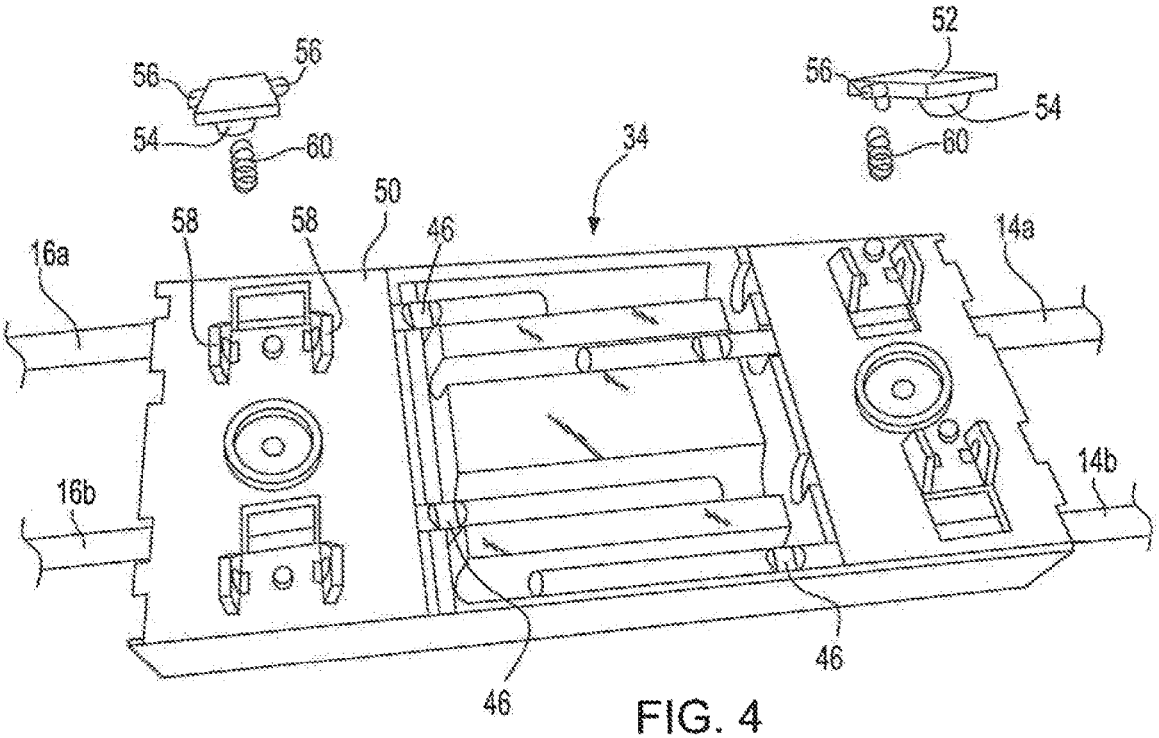
FIG. 4 is a top perspective view of a sliding arm mechanism housed within the main body of a toilet seat adapter, according to an exemplary embodiment of the invention.

In other embodiments of the invention, and as shown in FIG. 4, top wall 50 of sliding mechanism 34 is provided with spring-based flaps 52 having an underside projection 54 that is configured to insert into any of the notches 46 in arms 14*a*, 14*b*, and/or 16*a*, 16*b*. For example, with continued reference to FIG. 4, flaps 52 are shown having two opposing axles 56 that are configured to insert into respective slots in parallel posts 58. A spring 60 is positioned at a first end of the flap 52 between the top wall 50 and underside of the flap 52, which urges the first flap end upward and the second end downward to maintain projection secured within a notch 46. When the projection 54 is correctly positioned within the detent, force is required to overcome the spring bias and slide the projection 54 out of the detent.

Figure 9A:
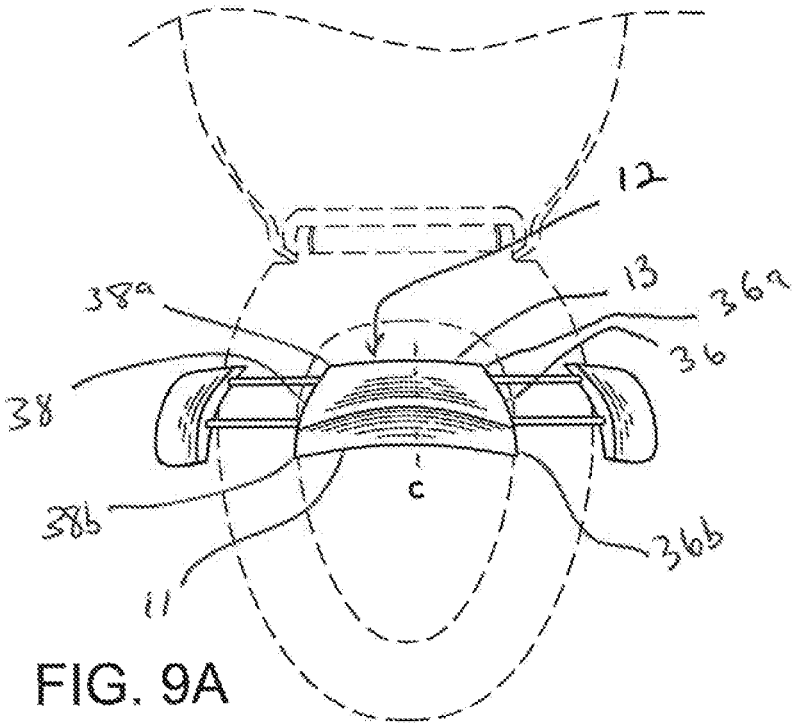
FIG. 9A shows a top plan view of an exemplary set up of a toilet seat adapter, according to an exemplary embodiment of the invention.
Figure 9B:
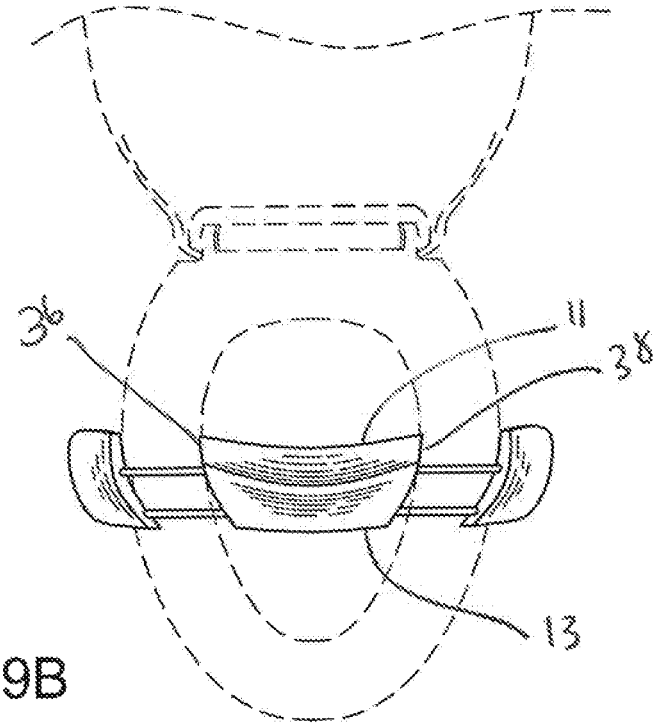
FIG. 9B show a top plan view of the toilet seat adapter of FIG. 9A installed in a reverse direction in accordance with exemplary embodiments of the invention.
Figure 10:
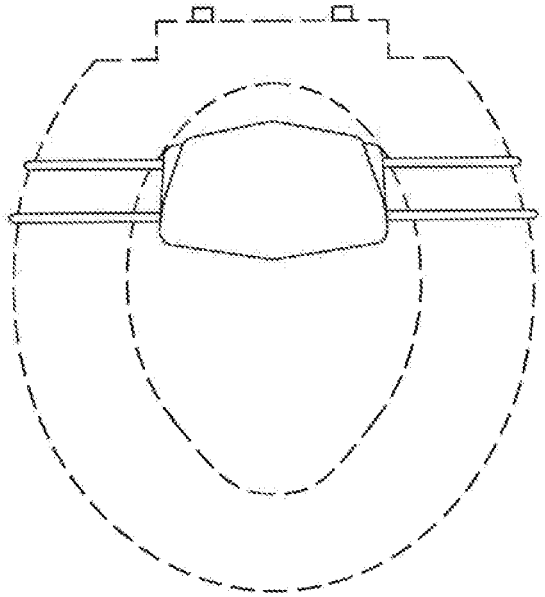
FIGS. 10-15 are top plan views of toilet seat adapters of different shapes and sizes, according to exemplary embodiments of the invention.
Figure 11:
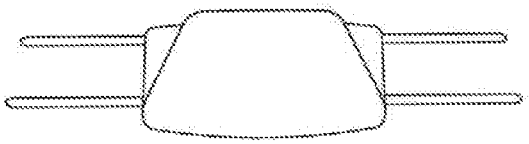
Figure 12:
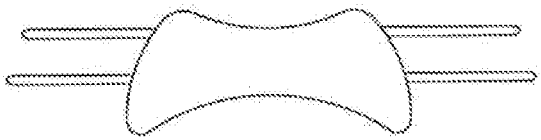
Figure 13:
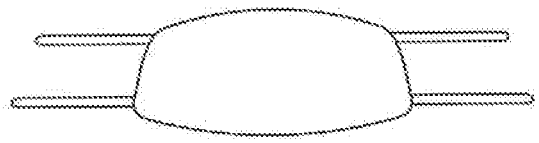
Figure 14:
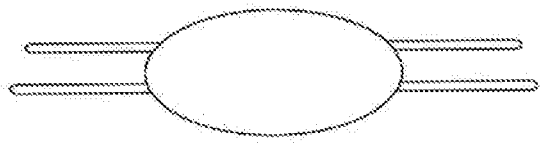
Figure 15:
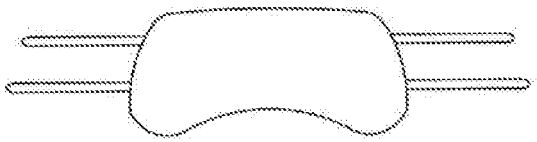

In an exemplary use of the adapter 10, the user grips handles 18 and 20 to pull pairs of arms 14 and 16 from main body 12. The user extends arms 14 and 16 over the existing toilet seat to extend beyond the outer circumference of the seat. When the user places the adapter 10 within the opening on the existing seat, the user then pushes arms 14 and 16 back into the body 12 to adjust the adapter 10 to the outer rim of the toilet seat. When arms 14 and 16 are pushed back into the body 12, the lower contacting surface 17 of terminal ends of arms 14 and 16 slip between the toilet seat and the rim of the toilet bowl. Once correctly positioned and properly adjusted, the adapter provides a narrowed opening to accommodate the small size of a child. It will be understood that main body 12 may be applied to a front aspect of a toilet seat (e.g. as shown in FIG. 9B) whereby an opening is created between the adapter 10 and the rear aspect of a toilet seat. Handles 18 and 20 provide the child with extra support and stability, while also preventing contact with the potentially unsanitary toilet. At the end of use, the user again pulls on handles 18 and 20 to extend arms 14 and 16 to release the adapter from the existing toilet seat. Once removed, the user may use handles 18 and 20 to push arms 14 and 16 back into the main body 12, creating a small packable unit for easy portability.

Figure 5:
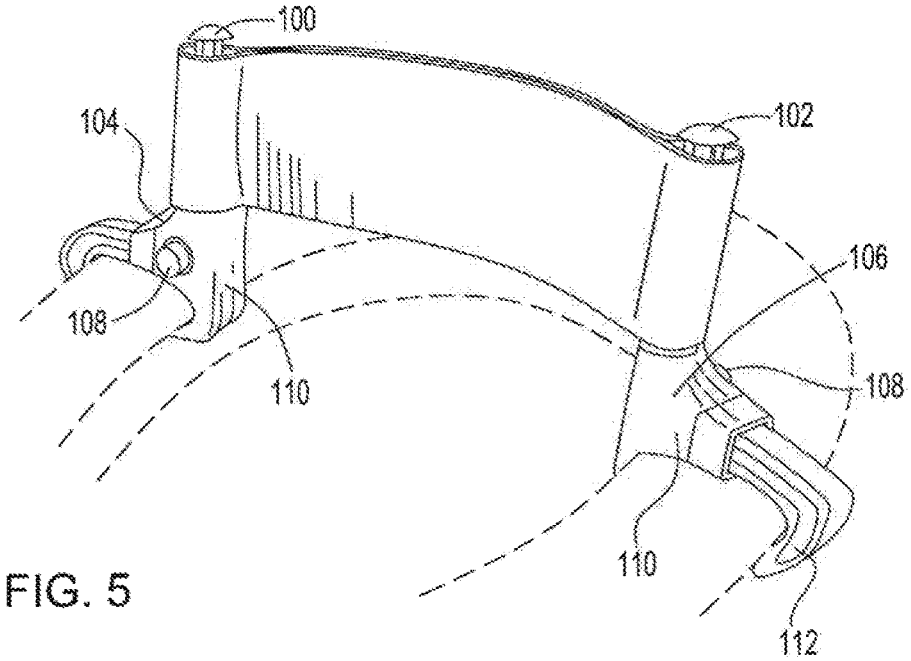
FIG. 5 is a perspective view of a toilet seat adapter, according to an exemplary embodiment of the invention.

FIG. 5 shows another embodiment of the present invention where the adapter 10 is formed of vertical posts 100 and 102. Clamping mechanisms 104 and 106 are located at the end of both vertical posts 100 and 102, respectively, to attach the adapter 10 to the toilet seat. In embodiments of the invention, a flexible material is secured between arms 100 and 102 to provide extra back support for the child. In embodiments of the invention, clamping mechanisms 104 and 106 both include a locking mechanism 108, including, but not limited to, a locking pin, to secure the adapter 10 on the toilet seat and prevent movement.

In an exemplary use of the embodiment shown in FIG. 5, arms 100 and 102 are extended across the standard toilet seat and positioned at a certain depth to narrow the opening of the seat to accommodate a child. Clamping mechanisms 104 and 106 are extended from the inner circumference to the outer rim of the toilet seat, and locked into position by use of a locking mechanism 108.

Figure 6:
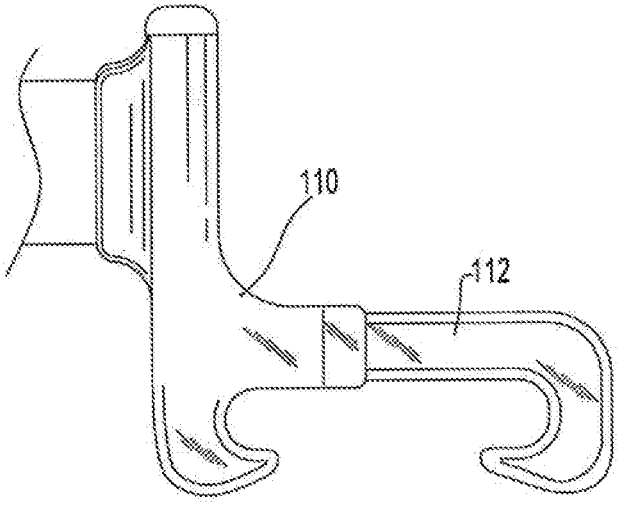
FIG. 6 is a front plant view of a clamping mechanism of a toilet seat adapter, according to an exemplary embodiment of the invention.
Figure 7:
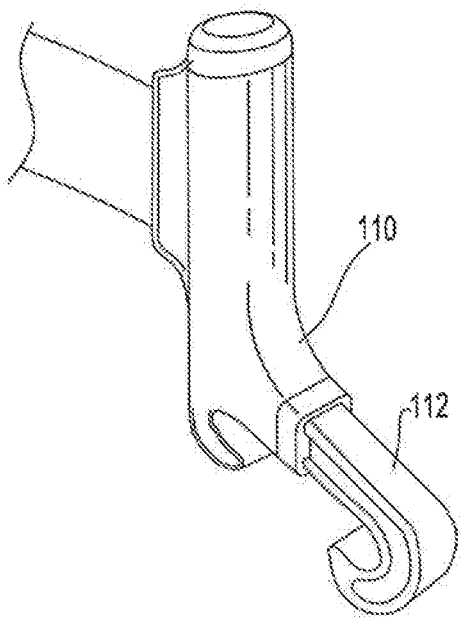
FIG. 7 is a side perspective view of a clamping mechanism of a toilet seat adapter, according to an exemplary embodiment of the invention.
Figure 8:
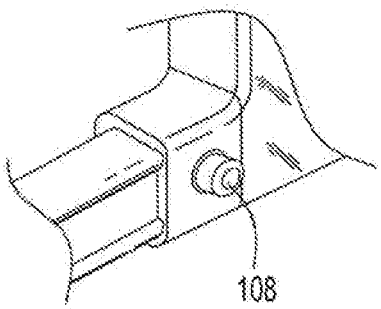
FIG. 8 is a side perspective view of a locking mechanism of the clamping mechanism of a toilet seat adapter, according to an exemplary embodiment of the invention.

In embodiments of the invention, clamping mechanism (e.g. clamping mechanisms 104, as shown in FIG. 6-7) is formed of a first fixed hook member 110 that is configured to capture an inside rim of a toilet seat and a moveable hook member 112 that is disposed facing fixed hook member 110. Moveable hook member 112 slides into a channel provided on fixed member and may be locked in place by a detent or similar locking mechanism.

In use, a user positions fixed hook 110 and moveable hook 112 to be spaced farther apart than the toilet seat segment. Next, the user applies the fixed hook 110 to the inside surface of the rim and then moves the moveable hook 112 a sufficient distance to lock it into place such that the hook segment 112 becomes positioned on the underside surface of the toilet seat. At the end of use, locking mechanism 108 is disengaged to release clamping mechanisms 104 and 106 from the toilet seat. Adapter 10 may then be easily stored and transported.

In embodiments of the invention, side surfaces 36 and 38 of main body 12 are formed as rounded or curved edges. As shown in FIG. 9A, the curvature of side surface 36 increases in angle (with respect to the centerline C) between corner 36*a* and corner 36*b*. The curvature of side surface 38 similarly increases in angle (with respect to the centerline C) between corner 38*a* and corner 38*b*. In embodiments, the curvature of surfaces 36, 38 is configured to substantially approximate a curvature of an inside side wall of a toilet seat. In embodiments of the invention, front wall 11 of main body 12 is greater in length than rear wall 13.

It will be understood that adapter 10 is configured for installation on either a back portion of toilet seat (i.e. the half closet to the tank) or to a front portion of a toilet seat (i.e. the half closest to the front of the toilet). For example, in the orientation shown in FIG. 9A adapter 10 is installed on a back portion of a toilet seat. In this orientation, shorter rear wall 13 is positioned facing the rear of the toilet. For installation on a front portion of a toilet seat (e.g. as shown in FIG. 9B), the orientation of adapter 9A is reversed such that shorter rear wall 13 faces the front of the toilet. It will be understood that in either orientation, curvatures of side surfaces 36, 38 substantially approximate the curvature of the inside opening of the toilet seat.

In embodiments of the invention, handles 18 and 20 have inside walls that are complementary to the curvature of side surfaces 36, 38. For example, whereas side surfaces 36 comprises substantially convex contours, inside walls of handles are provided with complimentary substantially concave contours.

Figure 24:
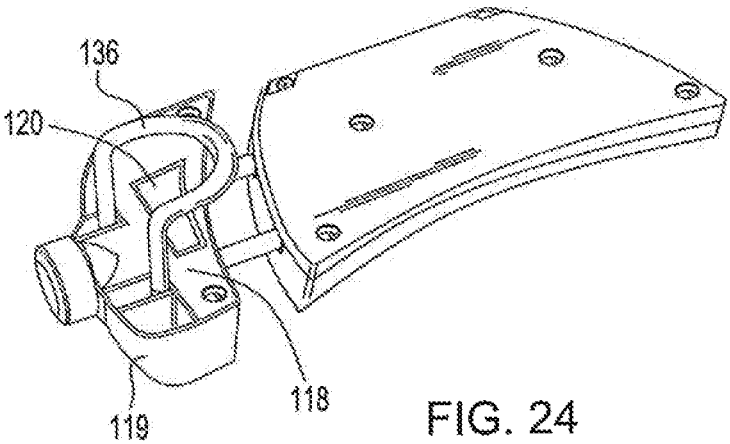
FIG. 24 is a bottom perspective view of a toilet seat adapter with an adjustment dial mechanism, according to an exemplary embodiment of the invention.
Figure 25:
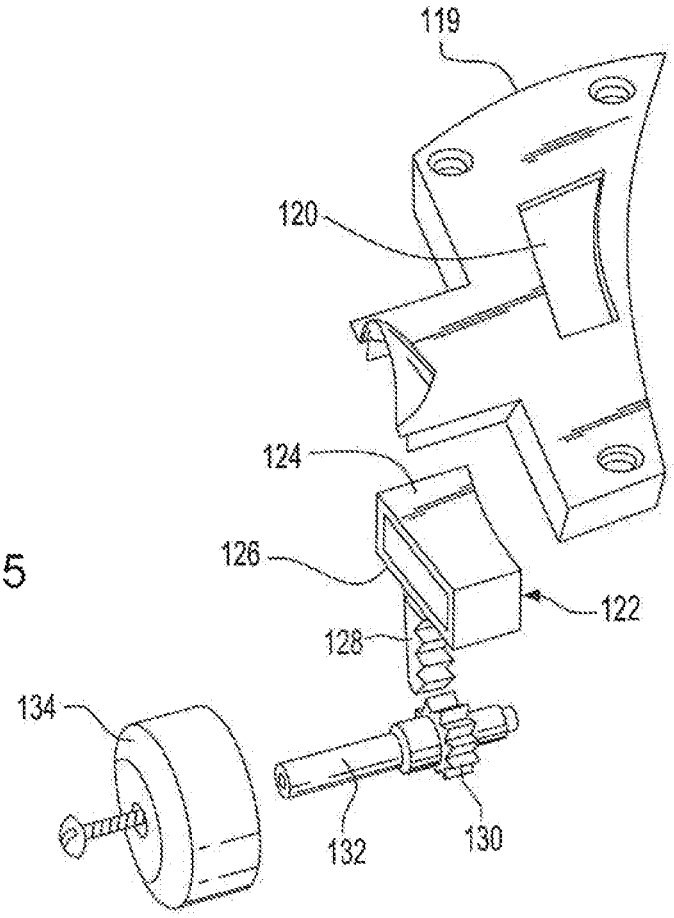
FIG. 25 is an exploded view of a toilet seat adapter with an adjustment dial mechanism, according to an exemplary embodiment of the invention.

It will be understood by those of ordinary skill in the art that any of various tensioning or clasping mechanisms may be used to temporarily secure the device to a toilet seat in embodiments of the invention. For example, FIGS. 24 and 25 show a tensioning system formed of a movable platform that may be lowered to contact a toilet seat. For example, as shown in FIG. 24, an underside surface 118 of handle 119 is provided with a cutout 120. A cooperating movable platform 122 stored inside the handle 119 is configured to be sized and shaped to fit within cutout 122 so that it may be extended from the inside of the handle and then retracted back into the space within the handle.

As shown, moveable platform 122 is provided with a lower, substantially flat contacting surface 124 and an upper surface 126. Upper surface of platform 122 is connected to a rack 128 that is engageable with a cooperating pinion wheel 130. As shown, pinion wheel 130 is attached to or carried on a rod 132 or similar axle. In embodiments of the invention, a first end of the rod 132 inserts into and is connected to a disc-shaped dial 134 that is positioned on the side of handle 119. Thus, in embodiments of the invention, when a user turns dial 134 in a first direction, rod 132 and pinion wheel 130 cooperatively turn in the first direction to urge rack 128 in a first direction. Movement of the rack 128 in a first direction causes attached platform 122 to move in a first direction (e.g. toward the ground when the device is positioned on a toilet seat) to emerge from cutout 120. The user may continue to rotate dial 134 until platform 122 contacts the upper surface of a toilet seat. When platform is so deployed, the toilet seat is gripped by platform 122 contacting an upper surface of the toilet seat and by U-shaped contacting surface 136 contacting the underside surface of the toilet seat.

In use, a user extends the handles so that the space between respective U-shaped contacting surfaces (e.g. 136) is greater that the distance between the outside walls of a toilet seat. The user then positions the device over a toilet seat and pushes the handles toward the center to capture the toilet seat. Next, the user adjusts the respective dials on each handle to deploy the respective platforms to emerge from the cutouts and contact the toilet seat—thereby gripping the same. To remove the device, a user performs these steps in reverse. For example, the user turns the respective dials in a second direction to cause the rack to move in a second direction and thus retract the platform into the handles. Next, the user pulls the handles outward (away from the center) to release the respective arms from the toilet seat.

Figure 26:
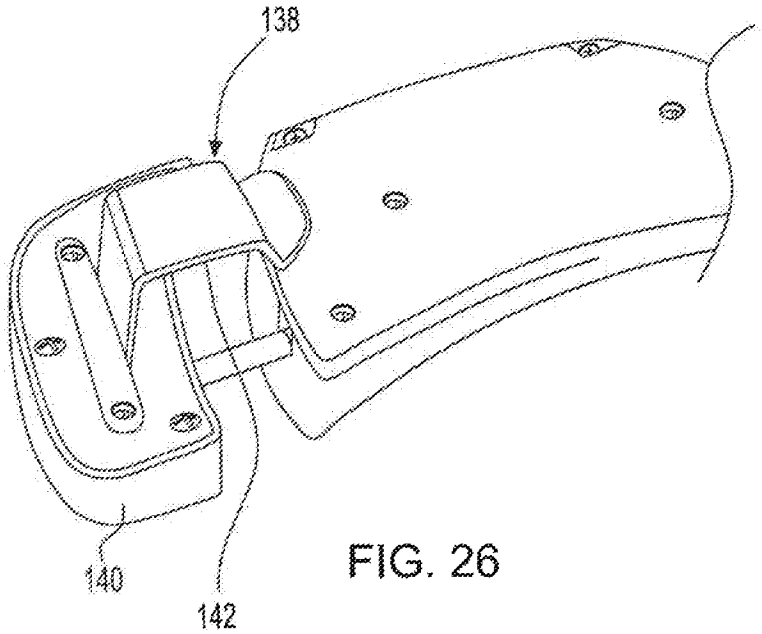
FIG. 26 is a bottom perspective view of a toilet seat adapter with a formed spring steel foot, according to an exemplary embodiment of the invention.

In embodiments of the invention, and with reference to FIG. 26, device may be provided with a clamp 138 or similar bracket that is formed of a flexible metal material. For example, as shown, a clamp 138 formed of spring steel or similar material having similar qualities is attached to the underside of handles (e.g. 140). Clamp 138 is formed by bending steel segment into the shape of a hook or similar clamp. In embodiments of the invention, clamp 138 is forms an underside contacting surface 142 that is disposed below and substantially parallel to the underside of handle 140. In embodiments of the invention, the distance between the contacting surface 142 and underside of handle 140 is less than an average thickness of a toilet seat. In this regard, a user may spread the clamp 138 to insert onto a toilet seat but due to the spring qualities of the material, the clamp 138 will maintain a grip on the toilet seat.

Figure 27:
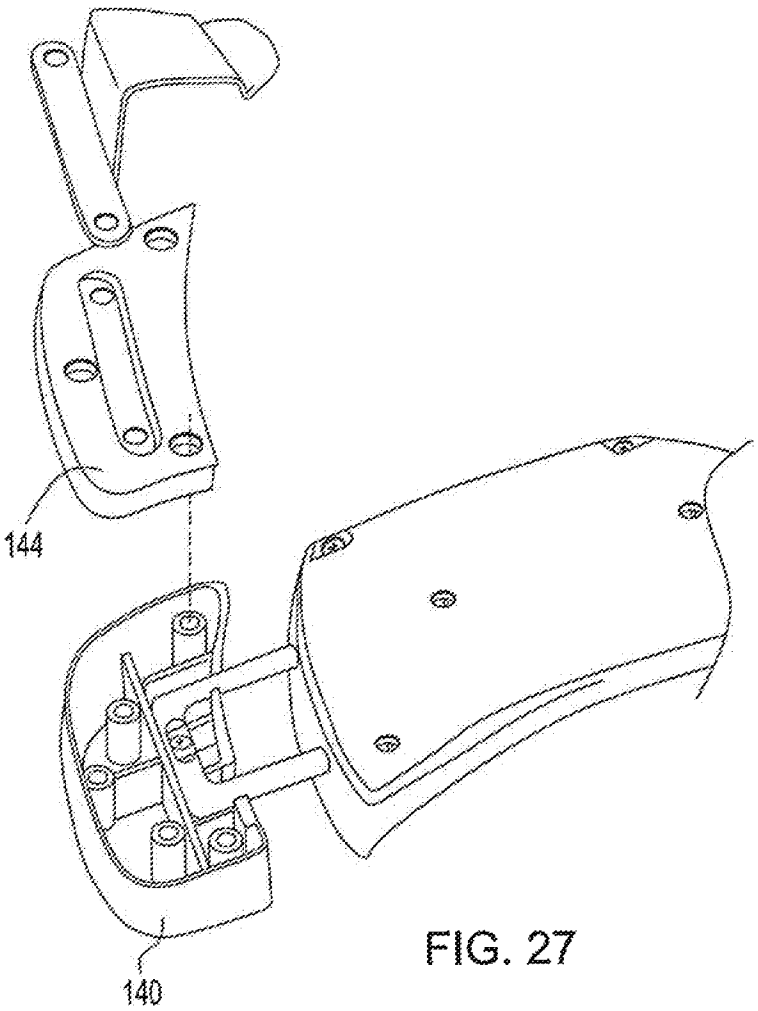
FIG. 27 is an exploded view a toilet seat adapter with a formed spring steel foot, according to an exemplary embodiment of the invention.

FIG. 27 shows an exploded view of a spring clamp assembly. As shown, clamp 138 may be connected to an intermediate plate 144, which is connected to underside of handle 140.

Figure 28:
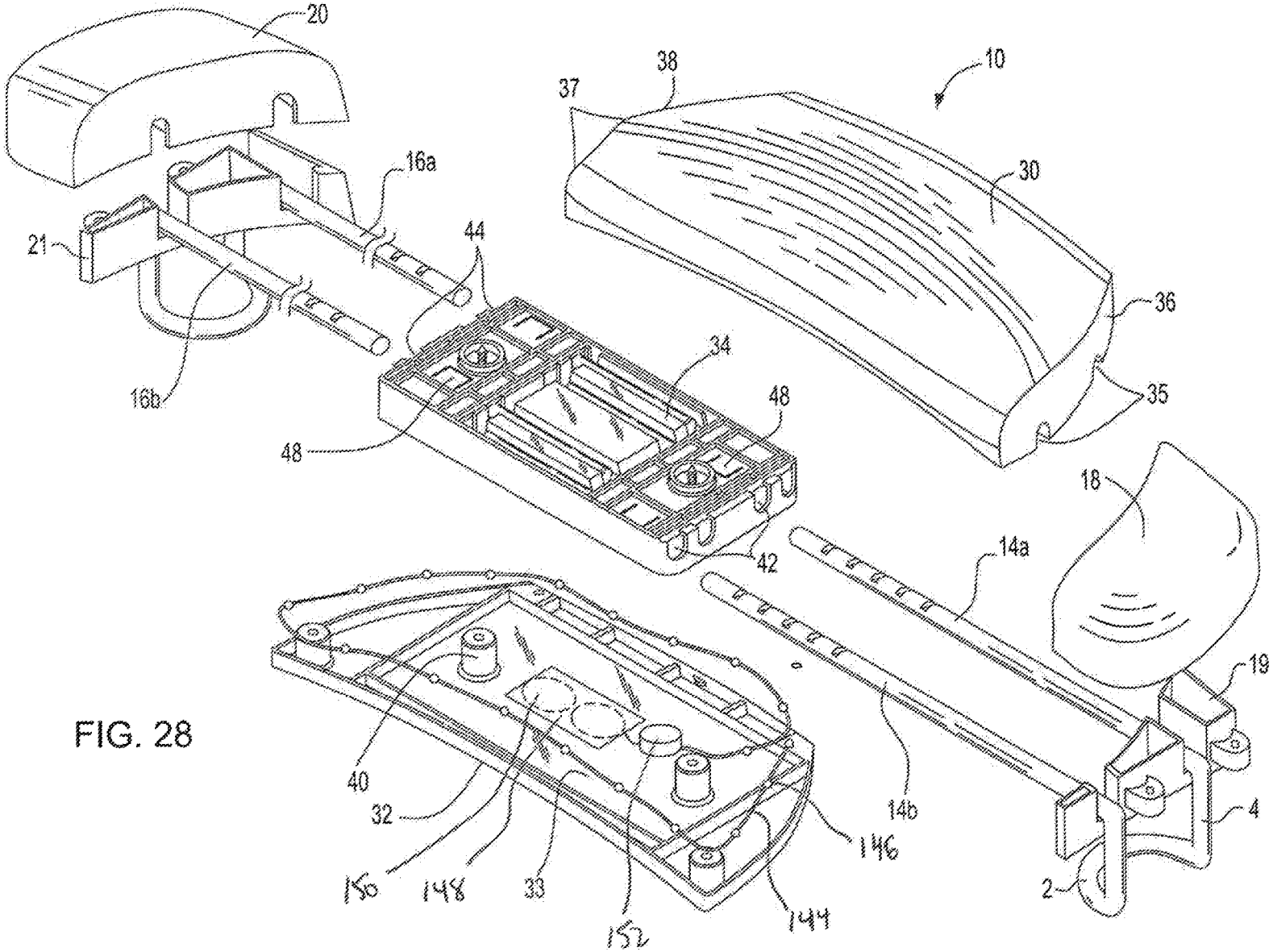
FIG. 28 is an exploded view of a toilet seat adapter having an integrated light system in accordance with embodiments of the invention.

FIG. 28 shows an exploded view of an adapter having an integrated light system in accordance with embodiments of the invention. In embodiments of the invention one or more bulbs or LEDs are disposed in the inside cavity of the main body 12 of adapter 10. In embodiments of the invention, at least one panel is formed of transparent, semi-transparent or translucent material. For example, upper surface 31 of seat top 30 is formed of translucent material to allow light emitted from bulbs or LEDs to projection upward. In other embodiments, both seat top 30 and seat base 32 are formed of transparent, semi-transparent or translucent material.

With continued reference to FIG. 28 a wire 144 is shown that electrically connects a plurality of LEDs 146. In embodiments of the invention, LEDs are equally spaced apart.

Wire 144 emanates from a battery compartment 148 which houses one or more batteries 150. In embodiments of the invention, a controller such a microcontroller 152 is provided to control functionalities such as on/off, light intensity, light timer among other possible functionalities.

In embodiments of the invention, LEDs 146 are positioned proximate to the outer confines of seat base 32. It will be understood that LEDs may be positioned anywhere within the cavity defined by seat top 30 and seat base 32. It will be further understood that LEDs or similar bulbs may be positioned on any surface of the main body 12 such as applied to or embedded in a panel of seat top 30 and/or seat base 32 (e.g. on underside surface of seat base 32).

Figure 29:
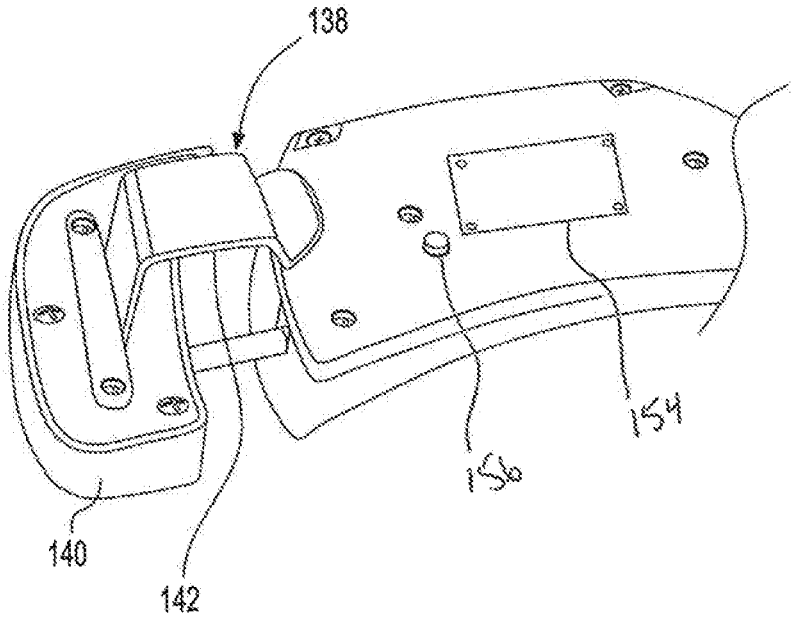
FIG. 29 is a bottom view of the toilet seat adapter of FIG. 28 in accordance with embodiments of the invention.

FIG. 29 shows an underside surface of seat base 32. As shown, a door 154 is provided to allow access to battery compartment 148 to allow a user to insert and change batteries. In embodiments of the invention, an on/off switch 156 is provided on the underside surface which allows a user to power on and power off the LEDs 146. In embodiments of the invention, on/off switch is a spring biased post that when depressed by a user alternatively allow or disallow current from the batteries 150 to the LEDs 146.

Having described the subject matter of the application with regard to specific embodiments, it is to be understood that the description is not meant as a limitation since further modifications and variations may be apparent or may suggest themselves to those skilled in the art. It is intended that the present application cover all such modifications and variations.

What is claimed is:

1. A toilet seat adapter, comprising:

a main body having an upper surface, an underside surface, a front wall having a first length, a rear wall having a second length, and at least a first side wall comprising a curved surface;

wherein the main body is configured to be applied on a toilet seat in at least a first orientation and a second orientation, whereby in the first orientation, the front wall faces a front of a toilet and whereby in the second orientation, the front wall faces a rear of a toilet;

the main body having one or more interior channels sized and shaped to retain a movable arm;

a movable arm having a first end housed within an interior channel of the one or more interior channels of the main body, the movable arm extending from the first side wall of the main body;

the movable arm being movable in a first direction toward the first side wall, the movable arm being further movable in a second direction away from the first side wall of the main body;

wherein the movable arm comprises a terminal end that is configured to grip a toilet seat.

2. The toilet seat adapter of claim 1 whereby the first length of the front wall is greater than the second length of the rear wall.

3. The toilet seat adapter of claim 1, whereby the terminal end that is configured to grip a toilet seat comprises a clamp.

4. The toilet seat adapter of claim 1, whereby the terminal end of the movable arm further comprises a handle.

5. The toilet seat adapter of claim 4, whereby the handle comprises an inside wall comprising a substantially concave contour.

6. A toilet seat adapter, comprising:

a main body having an upper surface, an underside surface, a front wall having a first length, a rear wall having a second length, and at least a first side wall, the main body further comprising an internal chamber;

the main body having one or more interior channels sized and shaped to retain a movable arm;

one or more light emitting devices provided in the internal chamber of the main body;

a movable arm having a first end housed within an interior channel of the one or more interior channels of the main body, the movable arm extending from the first side wall of the main body;

the movable arm being movable in a first direction toward the first side wall, the movable arm being further movable in a second direction away from the first side wall of the main body;

wherein the movable arm comprises a terminal end that is configured to grip a toilet seat.

* * * * *